US008938898B2

(12) United States Patent
Lo et al.

(10) Patent No.: US 8,938,898 B2
(45) Date of Patent: Jan. 27, 2015

(54) DEVICES FOR THE IDENTIFICATION OF MEDICAL PRODUCTS

(75) Inventors: Denny Lo, Bethlehem, CT (US); Robert Huebner, Wallingford, CT (US); Jessica Perkins, Middletown, CT (US); Thomas Signore, Brookfield, CT (US)

(73) Assignee: Z-Medica, LLC, Wallingford, CT (US)

( * ) Notice: Subject to any disclaimer, the term of this patent is extended or adjusted under 35 U.S.C. 154(b) by 1277 days.

(21) Appl. No.: 11/634,531

(22) Filed: Dec. 6, 2006

(65) Prior Publication Data

US 2007/0251849 A1 Nov. 1, 2007

Related U.S. Application Data

(60) Provisional application No. 60/796,121, filed on Apr. 27, 2006.

(51) Int. Cl.
*G09F 13/20* (2006.01)
*A61J 1/00* (2006.01)

(52) U.S. Cl.
CPC . *G09F 13/20* (2013.01); *A61J 1/00* (2013.01); *A61J 2205/20* (2013.01); *A61J 2205/40* (2013.01)
USPC ..... 40/542; 424/443; 424/445; 602/48; 206/441

(58) Field of Classification Search
USPC ..... 40/329, 6; 602/79; 206/820
See application file for complete search history.

(56) References Cited

U.S. PATENT DOCUMENTS 2,688,586 A 9/1954 Eberl et al.
2,969,145 A * 1/1961 Hannauer, Jr. ..... 206/441
3,122,140 A 2/1964 Crowe et al.
3,181,231 A 5/1965 Breck
3,189,227 A * 6/1965 Hobbs et al. ..... 222/94
3,366,578 A 1/1968 Michalko (Continued)

FOREIGN PATENT DOCUMENTS

CA 1223208 6/1987
CN 1970090 A 5/2007

(Continued)

OTHER PUBLICATIONS

Co-pending U.S. Appl. No. 10/939,687, filed Sep. 13, 2004.

(Continued)

*Primary Examiner* — Charles A. Fox
*Assistant Examiner* — Shin Kim
(74) *Attorney, Agent, or Firm* — Knobbe Martens Olson & Bear LLP

(57) ABSTRACT

Devices in which components of medical kits are carried are identifiable by means other than by the naked eye. The means for identification is attached to or integral with the device and may comprise raised and lowered surfaces that can be read by touch; serrations disposed on an edge or surface; a fluorescent coating viewable under infrared or ultraviolet light; or a pattern that is viewable using a thermal imaging device such as night vision goggles. A package for retaining a medical item includes an identifying element of a material that is selectively viewable in response to light attributes of the material. A device for the visual identification of a package containing a medical item includes an identifying element comprising a material that is visually discernible in reduced-light environments via the use of night vision devices.

21 Claims, 4 Drawing Sheets

(56) References Cited

U.S. PATENT DOCUMENTS 3,386,802 A 6/1968 Michalko
3,538,508 A 11/1970 Young
3,550,593 A 12/1970 Kaufman
3,658,984 A 4/1972 Kamp
3,698,392 A 10/1972 Vogt et al.
3,723,352 A 3/1973 Warner et al.
3,763,900 A 10/1973 Solms-Baruth et al.
3,979,335 A 9/1976 Golovko et al.
4,373,519 A 2/1983 Errede et al.
4,374,044 A 2/1983 Schaefer et al.
4,379,143 A 4/1983 Sherry et al.
4,435,512 A 3/1984 Ito et al.
4,460,642 A 7/1984 Errede et al.
4,514,510 A 4/1985 Alexander
4,524,064 A 6/1985 Nambu
4,525,410 A 6/1985 Hagiwara et al.
4,569,343 A 2/1986 Kimura et al.
4,626,550 A 12/1986 Hertzenberg
4,631,845 A * 12/1986 Samuel et al. ..... 40/638
4,651,725 A 3/1987 Kifune et al.
4,717,735 A 1/1988 Stem
4,728,323 A 3/1988 Matson
4,748,978 A 6/1988 Kamp
4,822,349 A 4/1989 Hursey et al.
4,828,081 A * 5/1989 Nordstrom et al. ..... 190/102
4,828,832 A 5/1989 DeCuellar et al.
4,911,898 A 3/1990 Hagiwara et al.
4,938,958 A 7/1990 Niira et al.
4,956,350 A 9/1990 Mosbey
5,140,949 A * 8/1992 Chu et al. ..... 119/174
5,146,932 A 9/1992 McCabe
5,474,545 A 12/1995 Chikazawa
5,486,195 A 1/1996 Meyers et al.
5,502,042 A 3/1996 Gruskin et al.
5,538,500 A * 7/1996 Peterson ..... 602/48
5,556,699 A 9/1996 Nira et al.
5,578,022 A 11/1996 Scherson et al.
5,597,581 A 1/1997 Kaessmann et al.
5,599,578 A * 2/1997 Butland ..... 427/7
D386,002 S * 11/1997 Hinkle ..... D3/203.6
5,696,101 A 12/1997 Wu et al.
5,716,337 A 2/1998 McCabe et al.
5,725,551 A 3/1998 Meyers et al.
5,728,451 A 3/1998 Langley et al.
5,766,715 A * 6/1998 Garconnet ..... 428/40.1
5,788,682 A 8/1998 Maget
5,801,116 A 9/1998 Cottrell et al.
5,826,543 A 10/1998 Raymond et al.
5,855,570 A 1/1999 Scherson et al.
5,916,511 A 6/1999 Kotani et al.
5,941,897 A 8/1999 Meyers
5,964,239 A 10/1999 Loux et al.
5,964,349 A * 10/1999 Odagiri ..... 206/387.1
5,981,052 A 11/1999 Sugiyama
5,993,964 A 11/1999 Nakajima
6,037,280 A 3/2000 Edwards et al.
6,060,461 A 5/2000 Drake
6,086,970 A 7/2000 Ren
6,123,925 A 9/2000 Barry et al.
6,159,232 A 12/2000 Nowakowski
6,187,347 B1 2/2001 Patterson et al.
6,203,512 B1 * 3/2001 Farris et al. ..... 602/79
6,251,423 B1 6/2001 Bradford
6,372,333 B1 4/2002 Sugiyama et al.
6,428,800 B2 8/2002 Greenspan et al.
6,450,537 B2 * 9/2002 Norris ..... 283/71
6,475,470 B1 11/2002 Kayane et al.
6,481,134 B1 * 11/2002 Aledo ..... 40/661.09
6,486,285 B2 11/2002 Fujita
6,495,367 B1 12/2002 Isogawa et al.
6,523,778 B2 * 2/2003 Key et al. ..... 244/31
6,573,419 B2 6/2003 Naimer
6,590,337 B1 7/2003 Nishikawa et al.
6,622,856 B2 * 9/2003 Gallo et al. ..... 206/232
6,630,140 B1 10/2003 Grunstein
6,685,227 B2 * 2/2004 Merry et al. ..... 283/101
6,700,032 B1 3/2004 Gray
6,701,649 B1 * 3/2004 Brosi ..... 40/299.01
6,745,720 B2 6/2004 Rasner et al.
6,890,177 B2 5/2005 Dragan
6,998,510 B2 2/2006 Buckman et al.
7,125,821 B2 10/2006 Xu et al.
7,303,759 B2 12/2007 Mershon
7,371,403 B2 5/2008 McCarthy et al.
7,429,252 B2 9/2008 Sarangapani
7,595,429 B2 9/2009 Hursey
7,604,819 B2 10/2009 Huey et al.
7,825,133 B2 11/2010 Yi
7,858,123 B2 12/2010 Stucky
7,968,114 B2 6/2011 Huey et al.
8,063,264 B2 11/2011 Spearman et al.
8,114,433 B2 2/2012 Huey et al.
8,202,532 B2 6/2012 Huey et al.
8,252,318 B2 8/2012 Huey et al.
8,252,344 B2 8/2012 Hursey
8,257,731 B2 9/2012 Horn et al.
8,257,732 B2 9/2012 Huey et al.
8,277,837 B2 10/2012 Fischer et al.
8,383,148 B2 2/2013 Huey et al.
8,460,699 B2 6/2013 Huey et al.
8,512,743 B2 8/2013 Horn et al.
2002/0077653 A1 6/2002 Hudson et al.
2002/0197302 A1 12/2002 Cochrum et al.
2003/0018357 A1 1/2003 Luthra et al.
2003/0133990 A1 7/2003 Hursey et al.
2003/0175333 A1 9/2003 Shefer et al.
2003/0176828 A1 9/2003 Buckman et al.
2003/0199922 A1 10/2003 Buckman
2003/0208150 A1 11/2003 Bruder et al.
2003/0212357 A1 11/2003 Pace
2004/0005350 A1 1/2004 Looney et al.
2004/0013715 A1 1/2004 Wnek et al.
2004/0038893 A1 2/2004 Ladner et al.
2004/0121438 A1 6/2004 Quirk
2004/0131820 A1 7/2004 Turner et al.
2004/0166172 A1 8/2004 Rosati et al.
2004/0166758 A1 8/2004 Reichmann et al.
2004/0169033 A1 9/2004 Kuibira et al.
2004/0243043 A1 12/2004 McCarthy et al.
2005/0023956 A1 2/2005 Kwak et al.
2005/0058721 A1 3/2005 Hursey
2005/0070693 A1 3/2005 Hansen et al.
2005/0074505 A1 4/2005 Hursey
2005/0107826 A1 5/2005 Zhu et al.
2005/0118230 A1 6/2005 Hill et al.
2005/0119112 A1 6/2005 Pfenninger et al.
2005/0137512 A1 6/2005 Campbell et al.
2005/0143689 A1 6/2005 Ramsey, III
2005/0147656 A1 7/2005 McCarthy et al.
2005/0246009 A1 11/2005 Toner et al.
2005/0248270 A1 11/2005 Ghosh et al.
2005/0249899 A1 11/2005 Bonutti
2006/0034935 A1 2/2006 Pronovost et al.
2006/0078628 A1 4/2006 Koman et al.
2006/0116635 A1 6/2006 Van Heugten
2006/0121101 A1 6/2006 Ladizinsky
2006/0141018 A1 6/2006 Cochrum et al.
2006/0141060 A1 6/2006 Hursey et al.
2006/0159733 A1 7/2006 Pendharkar et al.
2006/0172000 A1 8/2006 Cullen et al.
2006/0178609 A1 8/2006 Horn et al.
2006/0193905 A1 8/2006 Ehringer et al.
2006/0211965 A1 9/2006 Horn et al.
2006/0211971 A1 9/2006 Horn et al.
2006/0271094 A1 11/2006 Hudson et al.
2006/0282046 A1 12/2006 Horn et al.
2007/0016152 A1 1/2007 Karpowicz et al.
2007/0031515 A1 2/2007 Stucky et al.
2007/0065491 A1 3/2007 Huey et al.
2007/0104768 A1 5/2007 Huey et al.
2007/0104792 A1 5/2007 Jenkins
2007/0134293 A1 6/2007 Huey et al.
2007/0142783 A1 6/2007 Huey et al.
2007/0154509 A1 7/2007 Wilcher et al.

(56) References Cited

U.S. PATENT DOCUMENTS

| | | | |
|---|---|---|---|
| 2007/0154510 | A1 | 7/2007 | Wilcher et al. |
| 2007/0154564 | A1 | 7/2007 | Stucky et al. |
| 2007/0160638 | A1 | 7/2007 | Mentkow et al. |
| 2007/0160653 | A1 | 7/2007 | Fischer et al. |
| 2007/0167971 | A1 | 7/2007 | Huey et al. |
| 2007/0251849 | A1 | 11/2007 | Lo et al. |
| 2007/0275073 | A1 | 11/2007 | Huey et al. |
| 2007/0276308 | A1 | 11/2007 | Huey et al. |
| 2007/0276345 | A1 | 11/2007 | Huey et al. |
| 2007/0281011 | A1 | 12/2007 | Jenkins et al. |
| 2008/0027365 | A1 | 1/2008 | Huey |
| 2008/0085300 | A1 | 4/2008 | Huey et al. |
| 2008/0097271 | A1 | 4/2008 | Lo et al. |
| 2008/0125686 | A1 | 5/2008 | Lo |
| 2008/0146984 | A1 | 6/2008 | Campbell et al. |
| 2008/0199539 | A1 | 8/2008 | Baker et al. |
| 2008/0206134 | A1 | 8/2008 | Lo et al. |
| 2008/0254146 | A1 | 10/2008 | Huey et al. |
| 2008/0254147 | A1 | 10/2008 | Huey et al. |
| 2008/0269658 | A1 | 10/2008 | Vinton et al. |
| 2008/0299226 | A1 | 12/2008 | Mentkow et al. |
| 2008/0317831 | A1 | 12/2008 | Lo |
| 2008/0319476 | A1 | 12/2008 | Ward et al. |
| 2009/0008261 | A1 | 1/2009 | Kotzeva et al. |
| 2009/0011394 | A1 | 1/2009 | Meglan et al. |
| 2009/0018479 | A1 | 1/2009 | McCarthy et al. |
| 2009/0043268 | A1 | 2/2009 | Eddy et al. |
| 2009/0047366 | A1 | 2/2009 | Bedard et al. |
| 2009/0053288 | A1 | 2/2009 | Eskridge, Jr. et al. |
| 2009/0074880 | A1 | 3/2009 | Ladizinsky |
| 2009/0076475 | A1 | 3/2009 | Ross et al. |
| 2009/0112170 | A1 | 4/2009 | Wells et al. |
| 2009/0123525 | A1 | 5/2009 | Bedard |
| 2009/0162406 | A1 | 6/2009 | Basadonna et al. |
| 2009/0186013 | A1 | 7/2009 | Stucky |
| 2009/0186071 | A1 | 7/2009 | Huey et al. |
| 2009/0232902 | A1 | 9/2009 | Liu et al. |
| 2009/0274769 | A1 | 11/2009 | Fregonese |
| 2009/0299253 | A1 | 12/2009 | Hursey |
| 2010/0035045 | A1 | 2/2010 | McAmish |
| 2010/0121244 | A1 | 5/2010 | Horn et al. |
| 2010/0184348 | A1 | 7/2010 | McAmish |
| 2010/0209531 | A2 | 8/2010 | Stucky et al. |
| 2010/0228174 | A1 | 9/2010 | Huey |
| 2010/0233248 | A1 | 9/2010 | Huey et al. |
| 2011/0015565 | A1 | 1/2011 | Hursey |
| 2011/0059287 | A1 | 3/2011 | McAmish |
| 2011/0064785 | A1 | 3/2011 | Daniels et al. |
| 2011/0150973 | A1 | 6/2011 | Bowlin et al. |
| 2011/0229849 | A1 | 9/2011 | Maurer et al. |
| 2011/0237994 | A1 | 9/2011 | Russ et al. |
| 2011/0268784 | A1 | 11/2011 | Huey |
| 2012/0004636 | A1 | 1/2012 | Lo |
| 2012/0070470 | A1 | 3/2012 | Pahari |
| 2012/0130296 | A1 | 5/2012 | Huey |
| 2012/0259262 | A1 | 10/2012 | Huey |
| 2013/0041332 | A1 | 2/2013 | Huey |
| 2013/0079695 | A1 | 3/2013 | Huey |
| 2013/0178778 | A1 | 7/2013 | Huey |
| 2013/0344131 | A1 | 12/2013 | Lo |

FOREIGN PATENT DOCUMENTS

| | | | |
|---|---|---|---|
| CN | 101104080 | | 1/2008 |
| CN | 1114984 | | 3/2008 |
| CN | 101541274 | | 9/2009 |
| CN | 101687056 | | 3/2010 |
| EP | 0 107 051 | | 9/1983 |
| EP | 0 296 324 | | 12/1988 |
| EP | 0296324 | | 12/1988 |
| EP | 0 353 710 | | 2/1990 |
| EP | 0826822 | A2 | 3/1998 |
| EP | 0888783 | A1 | 7/1999 |
| EP | 1159972 | | 5/2001 |
| EP | 1 663 090 | | 6/2006 |
| EP | 1690553 | A1 | 8/2006 |
| EP | 1714642 | | 10/2006 |
| EP | 1 810 697 | A2 | 7/2007 |
| EP | 1810697 | A2 | 7/2007 |
| EP | 1 679 087 | | 1/2010 |
| EP | 2 142 220 | | 1/2010 |
| EP | 1 667 623 | | 11/2010 |
| EP | 2 077 811 | | 11/2010 |
| EP | 2 292 196 | | 3/2011 |
| GB | 2 259 858 | | 3/1993 |
| GB | 2314842 | | 1/1998 |
| GB | 2 462 228 | | 2/2010 |
| HK | 1135892 | | 6/2010 |
| IN | 7088/DELNP/2009 | | 4/2008 |
| IN | 241410 | | 7/2010 |
| JP | S59-62050 | | 9/1984 |
| JP | 61145120 | | 7/1986 |
| JP | 01-096558 | | 10/1987 |
| JP | 2-45040 | | 2/1990 |
| JP | 9-504719 | | 5/1997 |
| JP | 2777279 | B2 | 7/1998 |
| JP | 10-337302 | | 12/1998 |
| JP | 11-071228 | | 3/1999 |
| JP | 11-178912 | | 7/1999 |
| JP | 11-332909 | A1 | 7/1999 |
| JP | 2002-530157 | | 9/2002 |
| JP | 2002-331024 | | 11/2002 |
| JP | 2003-66045 | | 3/2003 |
| JP | 2003-305079 | | 10/2003 |
| JP | 2005-015537 | | 1/2005 |
| JP | 2004123651 | | 7/2006 |
| TR | 2011 00164 | T4 | 9/2004 |
| WO | WO 95/05445 | | 2/1995 |
| WO | WO 95/12371 | | 5/1995 |
| WO | WO 96/40285 | | 12/1996 |
| WO | WO 99/13918 | | 3/1999 |
| WO | WO 00/30694 | | 6/2000 |
| WO | WO 00/66086 | | 11/2000 |
| WO | WO 01/82896 | A1 | 8/2001 |
| WO | WO 01/97826 | | 12/2001 |
| WO | WO 02/30479 | | 4/2002 |
| WO | WO 02/30479 | A1 | 4/2002 |
| WO | WO 02/060367 | A1 | 8/2002 |
| WO | WO 02/074325 | A1 | 9/2002 |
| WO | WO 03/074566 | | 9/2003 |
| WO | WO 2005/012493 | | 2/2005 |
| WO | WO 2005/027808 | A1 | 3/2005 |
| WO | WO 2005/030279 | | 4/2005 |
| WO | WO 2005/087280 | | 9/2005 |
| WO | WO 2005/123170 | | 12/2005 |
| WO | WO 2006/006140 | | 1/2006 |
| WO | WO 2006/012218 | A1 | 2/2006 |
| WO | WO 2006/086557 | | 8/2006 |
| WO | WO 2006/088912 | A2 | 8/2006 |
| WO | WO 2006/102008 | | 9/2006 |
| WO | WO 2006/110393 | | 10/2006 |
| WO | WO 2007/120342 | A2 | 10/2007 |
| WO | WO 2008/036225 | A2 | 3/2008 |
| WO | WO 2008/054566 | | 5/2008 |
| WO | WO 2008/109160 | | 9/2008 |
| WO | WO 2008/127497 | | 10/2008 |
| WO | WO 2008/128149 | | 10/2008 |
| WO | WO 2008/136806 | | 11/2008 |
| WO | WO 2008/157536 | | 12/2008 |
| WO | WO 2009/032884 | | 3/2009 |
| WO | WO 2009/109194 | | 9/2009 |
| WO | WO 2009/126917 | | 10/2009 |

OTHER PUBLICATIONS

Co-pending U.S. Appl. No. 10/939,869, filed Sep. 13, 2004.
Co-pending U.S. Appl. No. 11/023,869, filed Dec. 27, 2004.
Co-pending U.S. Appl. No. 11/054,918, filed Feb. 9, 2005.
Co-pending U.S. Appl. No. 11/082,716, filed Mar. 16, 2005.
Co-pending U.S. Appl. No. 11/303,607, filed Dec. 16, 2005.
Co-pending U.S. Appl. No. 11/404,126, filed Apr. 13, 2006.
Co-pending U.S. Appl. No. 11/544,238, filed Oct. 6, 2006.
Co-pending U.S. Appl. No. 11/584,079, filed Oct. 20, 2006.

(56) References Cited

OTHER PUBLICATIONS

Co-pending U.S. Appl. No. 11/586,968, filed Oct. 25, 2006.
Co-pending U.S. Appl. No. 11/590,427, filed Oct. 30, 2006.
Co-pending U.S. Appl. No. 11/592,477, filed Nov. 2, 2006.
Co-pending U.S. Appl. No. 11/606,617, filed Nov. 29, 2006.
Co-pending U.S. Appl. No. 11/633,687, filed Dec. 4, 2006.
Co-pending U.S. Appl. No. 11/634,673, filed Dec. 5, 2006.
Co-pending U.S. Appl. No. 11/654,409, filed Jan. 17, 2007.
Co-pending U.S. Appl. No. 11/710,106, filed Feb. 22, 2007.
Co-pending U.S. Appl. No. 11/715,057, filed Mar. 6, 2007.
Co-pending U.S. Appl. No. 12/101,336, filed Apr. 11, 2008.
Co-pending U.S. Appl. No. 12/101,346, filed Apr. 11, 2008.
Co-pending U.S. Appl. No. 12/140,356, filed Jun. 17, 2008.
Co-pending U.S. Appl. No. 12/204,129, filed Sep. 4, 2008.
U.S. Appl. No. 60/668,022, filed Apr. 4, 2005.
U.S. Appl. No. 60/708,206, filed Aug. 15, 2005.
U.S. Appl. No. 60/902,738, filed Feb. 21, 2007.
U.S. Appl. No. 60/955,854, filed Aug. 14, 2007.
U.S. Appl. No. 12/352,513, filed Jan. 12, 2009.
PCT Search Report for PCT/US2004/29809, dated Feb. 24, 2005.
International Search Report for Application No. PCT/US2004/029812, dated Jun. 14, 2005.
European Search Report for Application No. 05445078 dated Jun. 27, 2006.
Search Report for EP 05020602, dated Jul. 6, 2006.
PCT Search Report for PCT/US2005/046700, dated Jul. 6, 2006.
International Search Report for Application No. PCT/US2006/012487, dated Sep. 12, 2006.
International Search Report for Application No. PCT/US2006/004594, dated Nov. 3, 2006.
Search report for EP 06126082, dated May 11, 2007.
Supplementary Partial European Search Report for Application No. EP04783867 dated Jan. 29, 2008.
International Search Report for Application No. PCT/US2007/016509, dated Feb. 8, 2008.
International Search Report for EP 06123557, dated Feb. 29, 2008.
International Search Report for Application No. PCT/US2008/075191, dated Nov. 17, 2008.
Donald Voet & Judith Voet, "Molecular Physiology", Biochemistry, p. 1087-1096, vol. 64, 1990, John Wiley & Sons.
Ima-Eu, Kaolin, Oct. 2006, p. 1-2.
The Merck Index; 1989, pp. 1596-1597, abstract 10021.
Hursey, et al., Bandage Using Molecular Sieves, Apr. 18, 2002, International Application Published Under the PCT, WO 02/30479 A1.
Alam, et al., Comparative Analysis of Hemostatic Agents in a Swine Model of Lethal Groin Injury, Jun. 2003, The Journal of Trauma Injury, Infection, and Critical Care, vol. 54, No. 6, pp. 1077-1082.
M. Gielen, Solid State Organometallic Chemistry: Methods and Applications Physical Organometallic Chemistry, 1999, New York John Wiley & Sons, Ltd. (UK), V. 2, p. 156.
Le Van Mao, Raymond et al. "Mesporous Aluminosilicates prepared from Zeolites by Treatment with Ammonium Fluorosilicate." J. Mater. Chem. 1993. pp. 679-683, vol. 3, No. 6.
Dyer, A. et al. "Diffusion in heteroionic zeolites: Part 1. Diffusion of water in heteroionics natrolites." Microporous and Mesoporous Materials. 1998, pp. 27-38, vol. 21.
Wright, J.K. et al., "Thermal Injury Resulting from Application of a Granular Mineral Hemostatic Agent." The Journal of Trauma Injury, Infection, and Critical Care. 2004, pp. 224-230, vol. 57, No. 2.
Top, Ayben et al. "Silver, zinc, and copper exchange in a Na-clinoptilolite and resulting effect on antibacterial activity." Applied Clay Science. 2004, pp. 13-19, vol. 27.
Office Action for U.S. Appl. No. 11/398,161 dated Apr. 30, 2008.
U.S. Appl. No. 10/939,687, filed Sep. 13, 2004 including prosecution history, including but not limited to Non-Final Rejection dated Oct. 16, 2006, Final Rejection dated May 24, 2007, Non-Final Rejection dated Sep. 6, 2007, Final Rejection dated Nov. 28, 2007 and Examiner's Answer to Appeal Brief.
U.S. Appl. No. 10/939,869, filed Sep. 13, 2004 including prosecution history, including but not limited to Non-Final Rejection dated Feb. 8, 2008, Non-Final Rejection dated Sep. 17, 2008 and Final Rejection dated Apr. 17, 2009.
U.S. Appl. No. 11/023,869, filed Dec. 27, 2004 including prosecution history, including but not limited to Requirement for Restriction/Election dated Mar. 31, 2008, Non-Final Rejection dated May 12, 2008 and Non-Final Rejection dated Dec. 11, 2008.
U.S. Appl. No. 11/054,918, filed Feb. 9, 2005 including prosecution history, including but not limited to Non-Final Office Rejection dated Mar. 18, 2008, Final Rejection dated Sep. 16, 2008 and Non-Final Rejection dated Mar. 9, 2009.
U.S. Appl. No. 11/082,716, filed Mar. 16, 2005 including prosecution history, including but not limited to Non-Final Rejection dated Oct. 9, 2008.
U.S. Appl. No. 11/303,607, filed Dec. 16, 2005 including prosecution history, including but not limited to Requirement for Restriction/Election dated Feb. 21, 2008, Non-Final Rejection dated Apr. 29, 2008 and Non-Final Rejection dated Sep. 8, 2008.
U.S. Appl. No. 11/404,126, filed Apr. 13, 2006 including prosecution history, including but not limited to Requirement for Restriction/Election dated Sep. 16, 2008 and Non-Final Rejection dated Dec. 3, 2008.
U.S. Appl. No. 11/544,238, filed Oct. 6, 2006 including prosecution history, including but not limited to Requirement for Restriction/Election dated Dec. 11, 2008; Non-Final Office Action dated May 29, 2009.
U.S. Appl. No. 11/584,079, filed Oct. 20, 2006 including prosecution history, including but not limited to Non-Final Rejection dated Apr. 6, 2009.
U.S. Appl. No. 11/590,427, filed Oct. 30, 2006 including prosecution history, including but not limited to Non-Final Rejection dated Aug. 19, 2008 and Final Rejection dated May 26, 2009.
U.S. Appl. No. 11/592,477, filed Nov. 2, 2006 including prosecution history, including but not limited to Non-Final Rejection dated May 28, 2008 and Final Rejection dated Dec. 22, 2008.
U.S. Appl. No. 11/633,687, filed Dec. 4, 2006 including prosecution history, including but not limited to Requirement for Restriction/Election dated Jun. 25, 2008 and Non-Final Rejection dated Sep. 4, 2998.
U.S Appl. No. 11/634,673, filed Dec. 5, 2006 including prosecution history, including but not limited to Requirement for Restriction/Election dated Apr. 9, 2008, Non-Final Rejection dated May 12, 2008, Final Rejection dated Nov. 14, 2008 and Non-Final Rejection dated May 21, 2009.
U.S. Appl. No. 11/715,057, filed Mar. 6, 2007 including prosecution history, including but not limited to Non-Final Rejection dated Aug. 20, 2008 and Final Rejection dated Apr. 2, 2009.
Alam, et al., Application of a Zeolite Hemostatic Agent Achieves 100% Survival in a Lethal Model of Complex Groin Injury in Swine, May 2004, The Journal of Trauma Injury, Infection, and Critical Care, vol. 56, pp. 974-983.
Aldrich—Handbook of Fine Chemicals and Laboratory Equipment, 2000-2001, pp. 1177-1178.
Analgesics and Anti-inflammatory agents 2004, retrieved from the internet on May 26, 2010, URL: http://web.archive.org/web/20040904151322/http://faculty.weber.edu/ewalker/Medicinal_Chemistry/topics/Analgesia_antiinflam/Analgesics_anti-inflamitory.htm.
Army halts use of new first aid item to study more, Seattle PI, Dec. 24, 2008.
Army halts use of WoundStat, http://stripes.com, Apr. 23, 2009.
Army pulls anti clotting agent after Fort Sam study finds threat, MySanAntonio Military, Dec. 24, 2008.
Baker, Sarah E. et al., Controlling Bioprocesses with Inorganic Surfaces: Layered Clay Hemostatic Agents, Department of Chemistry and Biochemistry, University of California, Santa Barbara, American Chemical Association 2007, 19, pp. 4390-4392 (3 pages total).
Basadonna, G., et al.: "A novel kaolin coated surgical gauze improves hemostasis both in vitro and in vivo", Journal of Surgical Research, vol. 144, No. 2, Feb. 2008, p. 440, XP002534658, abstract.

(56) References Cited

OTHER PUBLICATIONS

Bethesda, MD, TraumaCure, Life-saving News for Battlefield Soldiers & Wounded Civilians FDA Clears Product to Stop Severe Bleeding, Sep. 10, 2007.
Butenas—Mechanism of factor Vlla-dependent coagulation in hemophilia blood, Hemostasis, Thrombosis, and Vascular Biology, Blood, Feb. 1, 2002—vol. 99, No. 3.
Carraway, et al., Comparison of a new mineral based hemostatic agent to a commercially available granular zeolite agent for hemostasis in a swine model of lethal extremity arterial hemorrhage, Resuscitation vol. 78, Issue 2, Aug. 2008.
Clay makers (raw materials) retrieved from the internet on Mar. 15, 2010, URL: http://web.archive.org/web/20020609175053/http://www.claymaker.com/ceramic_central/info/raw_clays.htm (year 2002, pp. 104).
Comparative Testing of Hemostatic Dressings in a Severe Groin Hemorrhage, Trauma & Resuscitative Medicine Department, NMRC, Aug. 2008.
Fruijtier-Polloth, "The safety of synthetic zeolites used in detergents", Arch Toxicol (2009) 83:23-25.
Galan, et al.: "Technical properties of compound kaolin sample from griva (Macedonia, Greece)", Applied Clay Science 1996 10:477-490.
Gibbar-Clements, et al.: "The Challenge of Warfarin Therapy", JSTOR: The American Journal of Nursing,vol. 100, No. 3 (Mar. 2000), pp. 38-40.
HemCon Medical Technologies Inc. 501(k) Summary, GhitoGauze, Mar. 20, 2009.
James, "Silver Copper Zeolite Guinea Pig Sensitization Study—Beuhler Method", Data Evaluation Report dated Oct. 3, 1989.
Kheirabadi, Army Assessment of New Hemostatic Products Suitable for Treating Combat Wounds, US Army Institute of Surgical Research, Aug. 11, 2008.
Kheirabadi, et al., Session IV-B, Paper 28, 8:20 a.m., Comparison of New Hemostatic Dressings with Currently Deployed Hemcon Bandage in a Model of Extremity Arterial Hemorrhage in Swine, Jan. 2009.
Kheirabadi, et al., The Journal of Trauma Injury, Infection, and Critical Care, Comparison of New Hemostatic Granules/Powders with Currently Deployed Hemostatic Products in a Lethal model of Extremity Arterial Hemorrhage in Swine, Feb. 2009, pp. 316-328.
Kheirabadi, Final Report, Title: Assessment of Efficacy of New Hemostatic Agents in a Model of Extremity Arterial Hemorrhage in Swine, U.S. Army Institute of Surgical Research, Ft. Sam Houston, TX 78234, Mar. 4, 2008.
Kovzun, I. G., et al.: "Application of nanosize clay-mineral systems in the complex therapy for hemophilia "A" patients", Database HCAPLUS [online], XP002534657, retrieved from STN Database accession No. 2009:502758 abstract & Nanosistemi, Nanomateriali, Nanotekhnologii, vol. 6, No. 2, 2008.
Macrina, VCU's Research Enterprise, Structure and Resources, Oct. 23, 2008.
Margolis, J., "Initiation of Blood Coagulation by Glass and Related Surfaces," J. Physiol., 1957, vol. 137, pp. 95-109.
Margolis, J., The Kaolin Clotting Time: A Rapid One-Stage Method for Diagnosis of Coagulation Defects, J. Clin. Pathol 1958, 11, pp. 406-409 (5 pages total).
Okada, et al.: "Preparation of zeolite-coated cordierite honeycombs prepared by an in situ crystallization method", Science and Technology of Advanced Materials 2004 5:479-484.
O'Reilly et al.: "Studies on Coumarin Anticoagulant Drugs—Initiaion of Warfarin Therapy Without a Loading Dose", Circulation by the American Heart Association, http://circ.ahajournals.org, 1968, 38, 169-177.
Ore-Medix, Traumastat Hemostatic Bandage, Aug. 7, 2008.
Permanent suspension of Woundstat use, https://email.z-medica.com, Apr. 17, 2009.
Reprinted related contents of US Alaract regarding QuikClot CombatGauze, Sep. 2008.
Sadler et al.: "Biochemstry and Genetics of Van Willebrand Factor", Annual Review of Biochemistry; 1998. 67:395-424.
Scott Sackinger's Medical Devices Professional Summary dated Mar. 2009.
Sinter. (2004). In the New Penguin Dictionary of Science. London: Penguin. Retrieved May 7, 2009, from http://www.credoreference.com/entry/7463549/.
Tactical Combat Casualty Care Guidelines, Feb. 2009.
TraumaCure, Innovative Wound Care Products for Wound Care Solutions, Apr. 24, 2009.
Vitrify—(2001). In Chambers 21s5t Century Dictionary. London. Chambers Harrap. Retrieved May 7, 2009, from http://www.credoreference.com/entry/1236485/.
Wagner, Holly, "Topical Oxygen Helps Hard-To-Heal Wounds Heal Faster and Better," Jan. 28, 2003, obtained from http://researchnews.osu.edu/archive/oxvwound.htm.
Ward, et al., The Journal of Trauma Injury, Infection, and Critical Care, Comparison of a New Hemostatic Agent to Current Combat Hemostatic Agents in a Swine Model of Lethal Extremity Arterial Hemorrhage, Aug. 2007, pp. 276-284.
Wound Stat, hhtp://shadowspear.com.
WoundStat found to be potentially hazardous, http://armytimes.com.
Wright, J. Barry et al.: "Wound management in an era of increasing bacterial antibiotic resistance: A role for topical silver treatment", American Journal of Infection Control, vol. 26 (6), 1998, pp. 572-577.
Z-Medica Corporation 510(k) Summary, QuikClot eX, Oct. 4, 2007.
U.S. Appl. No. 11/054,918, filed Feb. 9, 2005, including prosecution history, including but not limited to Office Action dated Mar. 18, 2008.
U.S. Appl. No. 12/555,876, filed Sep. 9, 2009, including prosecution history, including but not limited to Office Action dated Dec. 28, 2010 and Office Action dated May 27, 2011.
U.S. Appl. No. 11/592,477, filed Nov. 2, 2006, including prosecution history, including but not limited to Office Action dated May 28, 2008, Office Action and dated Dec. 22, 2008 and Office Action dated Jun. 18, 2009.
U.S. Appl. No. 11/643,673, filed Dec. 5, 2006, including prosecution history, including but not limited to Office Action dated May 12, 2008, Office Action dated Nov. 14, 2008, Office Action dated May 21, 2009 and Office Action dated Mar. 25, 2010.
U.S. Appl. No. 11/590,427, filed Oct. 30, 2006, including prosecution history, including but not limited to Office Action dated Aug. 19, 2008, Office Action dated May 26, 2009, Office Action dated Jun. 7, 2010 and Office Action dated Apr. 5, 2011.
U.S. Appl. No. 12/417,802, filed Apr. 3, 2009, including prosecution history, including but not limited to Office Action dated Jun. 11, 2010 and Office Action dated Jan. 25, 2011.
U.S. Appl. No. 11/633,687, filed Dec. 4, 2006, including prosecution history, including but not limited to Office Action dated Sep. 4, 2008 and Office Action dated Jun. 12, 2009.
U.S. Appl. No. 11/654,409, filed Jan. 17, 2007, including prosecution history, including but not limited to Office Action dated Mar. 30, 2010 and Final Office Action dated Oct. 25, 2010.
U.S. Appl. No. 11/715,057, filed Mar. 6, 2007, including prosecution history, Including but not limited to Non-Final Rejection dated Aug. 20, 2008 and Final Rejection dated Apr. 2, 2009.
U.S. Appl. No. 12/581,782, filed Oct. 19, 2009, including prosecution history, including but not limited to Office Action dated Mar. 16, 2011.
U.S. Appl. No. 10/939,869, filed Sep. 13, 2004, including prosecution history, including but not limited to Office Action dated Feb. 8, 2008, Office Action date Sep. 17, 2008, Final Office Action dated Apr. 17, 2009, Final Office Action dated Apr. 1, 2010, Final Office Action date Dec. 12, 2010 and Office Action dated May 17, 2011.
U.S. Appl. No. 11/082,716, filed Mar. 16, 2005, including prosecution history, including but not limited to Office Action dated Oct. 9, 2008.
U.S. Appl. No. 11/303,607, filed Dec. 16, 2005, including prosecution history, including but not limited to Office Action dated Apr. 29, 2008 and Office Action dated Sep. 8, 2008.
U.S. Appl. No. 11/404,126, filed Apr. 13, 2006, including prosecution history, including but not limited to Office Action dated Dec. 3, 2008, Office Action dated Dec. 21, 2009 and Notice of Abandonment dated Oct. 8, 2010.

(56) References Cited

OTHER PUBLICATIONS

U.S. Appl. No. 11/586,986, filed Oct. 25, 2006, including prosecution history, including but not limited to Office Action dated Feb. 19, 2010 and Office Action dated Jun. 3, 2010.
U.S. Appl. No. 10/939,687, filed Sep. 13, 2004, Including prosecution history.
U.S. Appl. No. 11/023,869, filed Dec. 27, 2004, including prosecution history, including but not limited to Office Action dated May 12, 2008, Office Action dated Dec. 11, 2008, Office Action dated Jan. 26, 2010 and Office Action dated Sep. 16, 2010.
U.S. Appl. No. 11/606,617, filed Nov. 29, 2006, including prosecution history, including but not limited to Office Action dated Jun. 12, 2009.
U.S. Appl. No. 11/710,106, filed Feb. 22, 2007, including prosecution history, including but not limited to Office Action dated Oct. 1, 2010.
U.S. Appl. No. 12/101,336, filed Apr. 11, 2008, including prosecution history, including but not limited to Office Action dated Mar. 22, 2010 and Notice of Abandonment dated Oct. 7, 2010.
U.S. Appl. No. 12/101,346, filed Apr. 11, 2008, including prosecution history, including but not limited to Office Action dated Mar. 19, 2010 and Office Action dated Sep. 15, 2010.
U.S. Appl. No. 12/140,356, filed Jun. 17, 2008, including prosecution history, including but not limited to Office Action dated Sep. 28, 2010 and Office Action dated Mar. 21, 2011.
U.S. Appl. No. 12/204,129, filed Sep. 4, 2008, including prosecution history, including but not limited to Office Action dated May 31, 2011.
U.S. Appl. No. 11/544,238, filed Oct. 6, 2006, including prosecution history, including but not limited to Office Action dated May 29, 2009 and Office Action dated Jun. 25, 2010.
U.S. Appl. No. 12/503,481, filed Jul. 15, 2009, including prosecution history, including but not limited to Office Action dated Dec. 27, 2010 and Office Action dated Jul. 5, 2011.
U.S. Appl. No. 13/175,380, filed Jul. 1, 2011 including prosecution history.
Angeloni, V., M.D.: "How to care for your wound," Heartland Dermatology & Skin Cancer P. C., copyright 2001, V. Angeloni MD.
U.S. Appl. No. 11/634,531, filed Dec. 6, 2006, including prosecution history, including but not limited to Office Action dated Feb. 4, 2009; Office Action dated Sep. 4, 2009, Office Action dated Mar. 29, 2010; Final Office Action dated Oct. 5, 2010; Office Action dated Jun. 23, 2011; BPAI Notice of Appeal dated Apr. 17, 2012, Appeal No. 2012-007306.
U.S. Appl. No. 12/204,129, filed Sep. 4, 2008, including prosecution history, including but not limited to Office Action dated May 31, 2011, Nov. 17, 2011, and Notice of Abandonment dated Jun. 20, 2012.
U.S. Appl. No. 12/555,876, filed Sep. 9, 2009, including prosecution history, including but not limited to Office Action dated Dec. 28, 2010, Office Action dated May 27, 2011, and Notice of Allowance dated Jun. 14, 2012.
U.S. Appl. No. 13/115,699, filed May 25, 2011 including prosecution history, including but not limited to Notice of Allowance dated May 30, 2012.
U.S. Appl. No. 13/526,431, filed Jun. 18, 2012 including prosecution history.
U.S. Appl. No. 10/939,869, filed Sep. 13, 2004, including prosecution history, including but not limited to Final Office Action dated May 17, 2011.
U.S. Appl. No. 12/140,356, filed Jun. 17, 2008, including prosecution history, including but not limited to Final Office Action dated Mar. 21, 2011.
U.S. Appl. No. 11/584,079, filed Oct. 20, 2006, including prosecution history, including but not limited to Office Action dated Apr. 6, 2009.
U.S. Appl. No. 11/634,673, filed Dec. 5, 2006, including prosecution history, including but not limited to Office Action dated Nov. 14, 2008.
U.S. Appl. No. 12/417,802, filed Apr. 3, 2009, including prosecution history, including but not limited to Office Action dated Jun. 11, 2010.
Webster's Dictionary definition of "expose" (1993).
U.S. Appl. No. 13/911,616, filed Jun. 6, 2013, including prosecution history.
Comparative Testing of Hemostatic Dressings in a Severe Groin Hemorrhage, Trauma & Resuscitative Medicine Department, NMRC, Aug. 2008 (Part 1 of 3, pp. 1-9).
Comparative Testing of Hemostatic Dressings in a Severe Groin Hemorrhage, Trauma & Resuscitative Medicine Department, NMRC, Aug. 2008 (Part 2 of 3, pp. 10-19).
Comparative Testing of Hemostatic Dressings in a Severe Groin Hemorrhage, Trauma & Resuscitative Medicine Department, NMRC, Aug. 2008 (Part 3 of 3, pp. 20-29).
U.S. Appl. No. 13/240,795, filed Sep. 22, 2011, including prosecution history.
U.S. Appl. No. 13/682,085, filed Nov. 20, 2012, including prosecution history.
Connor, William E.: "The Acceleration of Thrombus Formatin by Certain Fatty Acids," Journal of Clinical Investigation, vol. 41, No. 6, 1962.
Hubbard, et al.: "Ionic charges of glass surfaces and other materials, and their possible role in the coagulation of blood," Journal of Applied Physiology, Mar. 1, 1960, vol. 15, No. 2, pp. 265-270.
Ross, et al., "The Kaolin Minerals," J. Amer. Ceramic Soc., vol. 13, issue 3, pp. 151 to 160, Mar. 1930.
Curasorb Calcium Alginate Dressings information page, http://www.kendallhq.com/kendallhealthcare/pageBuilder.aspx?webPageID=0&topicID=70966&xsl=xsl/productPagePrint.xsl (last accessed May 22, 2012).
Hollister Wound Care Restor Calcium Alginate Dressing, Silver instruction manual and information booklet, *available* at http://hollisterwoundcare.com/files/pdfs/ifus/Restore907814B407ColorBreak.pdf (last accessed May 22, 2012).
Medline Maxorb Extra AG Silver Alginate, http://www.medicaldepartmentstore.com/Medline-Maxorb-p/1560.htm (last accessed May 22, 2012).
"Mastering the Art of Innovative Thinking," (color brochure) FMC BioPolymer, 2001 FMC Corporation.
Davis et al., 1H—NMR Study of Na Alginates Extracted from *Sargassum* spp. in Relation to Metal Biosorption, 110 Applied Biochemistry and Biotechnology 75 (2003).
Hahn, Lynn: "High temperature 1H NMR to determine the relative amounts of guluronate and mannuronate in the sodium alginate sample", Intertek, ASA, Analytical Report, Report No. 60665 v 1, dated May 6, 2012.
Manugel® GMB alginate, FMC BioPolymer, Know how. It works.sm Product Specifications, 2011 FMC Corporation.
U.S. Appl. No. 10/939,869, filed Sep. 13, 2004 including prosecution history, including but not limited to Non-Final Rejection dated Feb. 8, 2008, Non-Final Rejection dated Sep. 17, 2008, Final Rejection dated Apr. 17, 2009, Final Office Action dated Apr. 1, 2010, Final Office Action dated Dec. 12, 2010; Final Office Action dated May 17, 2011 and Notice of Allowance dated Mar. 23, 2012.
U.S. Appl. No. 13/922,115, filed Jun. 19, 2013, including prosecution history.
EPO Extended Search Report, re EP Application No. 12163455, dated Sep. 12, 2012.
Lin et al., Synthesis of Hybridized Polyacrylic Acid-Kaolin Material and Its Superwater Absorbent Performance, J. Huaqiao Univ. (Nat. Sci.) Mar. 2000.
Long et al., Synthesis of Bentonite-superabsorbent Composite, J. Guilin Inst. Tech., Feb. 2004.
U.S. Appl. No. 13/593,310, filed Aug. 23, 2012, including prosecution history.
U.S. Appl. No. 13/595,932, filed Aug. 27, 2012, including prosecution history.
U.S. Appl. No. 13/598,381, filed Aug. 29, 2012, including prosecution history.
Dictionary of Traditional Chinese Medicine, "Astringents and Haemostatices," The Commercial Press, Ltd., Apr. 1984 [ISBN 962 07 3051 8], pp. 216-217, total 4 pages.

(56) References Cited

OTHER PUBLICATIONS

Hempen, et al., A Materia Medica for Chinese Medicine, Plants minerals and animal products, Churchill Livingston Elsevier, 2009, [ISBN 978 0 443 100949], pp. 832-833 (Halloysitum rubrum, Chi shi zi), total 5 pages.
Hsu, et al. Orintal Materia Medica—a concise guide, pp. 310-311, 612-613, 32-34, total 12 pages. Oriental Healing Arts Institute, 1986. [ISBN 0 941 942 22 8].
Huang, Pharmacology of Chinese Herbs, Second Edition, p. 243 (Antidiarrheal Herbs), total 3 pages. CRC Press 1999. [ISBN 0 8493 1665 0].
Li; et al. Chinese Materia Medica—Combinations and Applications, Donica Publishing Ltd., 2002, [ISBN 1 901149 02 1], p. 622 (Ch. 18 Herbs for Promoting Astriction), total 5 pages.
Soine et al., Roger's Inorganic Pharmaceutical Chemistry, Lea & Febiger 1967, p. 462-463 (Aluminum and Aluminum Compounds), [QV744 S683r 1967] total 5 pages.
Wu, Jing-Nuan, "An Illustrated Chinese Materia Medica," Oxford University Press, Inc. 2005 (13 pages).
Xinrong, Traditional Chinese Medicine, A Manual from A-Z, Symptoms, Therapy and Herbal Remedies, [ISBN 3 540 42846 1], p. 470 (total 3 pages), Springer-Verlag Berlin Heidelberg 2003.
Yanchi, The Essential Book of Traditional Chinese Medicine, vol. 2: Clinical Practice, p. 155-157 (Traditional Chinese Prescriptions), , 142-143 (Chinese Medicinal Herbs) total 8 pages. [ISBN 0 231 06518 3 9v.2] 1988.
U.S. Appl. No. 13/759,963, filed Feb. 5, 2013, including prosecution history.
Angeloni, V., M.D.: "How to care for your wound.", Heartland Dermatology & Skin Cancer P. C., copyright 2001, V. Angeloni MD.
CA Office Action re Application No. 2,590,595, filed Dec. 22, 2005, Office Action dated Apr. 17, 2009.
CA Office Action re Application No. 2,677,606 filed Mar. 6, 2008, Office Action dated Jan. 26, 2012.
CA Office Action re Application No. 2,677,606 filed Mar. 6, 2008, Office Action dated Sep. 30, 2011.
Caloplast (Kaoline Poultrice), South African Electronic Package Inserts, Information presented by Malahyde Information Systems, Copyright 1996-1998, printed from home.intekom.com/pharm/allied/caloplst.html#INDICATIONS, two pages.
EPO Examination Report re EP 1 663 090, dated Dec. 8, 2011.
Griffin, John H., Role of surface in surface-dependent activation of Hageman factor (blood coagulation Factor XII), Proc. Natl. Acad. Sci. USA, vol. 75, No. 4, Apr. 1978, pp. 1998-2002 (5 pages total).
PCT International Search Report re Application No. PCT/US2010/041741, dated Nov. 26, 2010.
Reprinted related contents of U.S. Abstract regarding quickclot Combat Gauze (reprinted May 21, 2009).
Vlok, Marie E.: "Kaoline poultice", Manual of Nursing, vol. 1, Basic Nursing, revised ninth edition, p. 269. Copyright Juta & Co, Ltd., Lansdowne, South Africa, first published 1962.
Wound Stat, http://shadowspear.com/vb/showthread.php?t=16586 dated Dec. 22, 2008, last accessed Apr. 16, 2009.
WoundStat found to be potentially hazardous, Army News, news from Iraq . . . , http://armytimes.com/news/2009/04/army_woundstat_042009w/, posted Apr. 20, 2009, last accessed Apr. 20, 2009.
U.S. Appl. No. 12/352,513, filed Jan. 12, 2009 including prosecution history.
U.S. Appl. No. 11/592,477, filed Nov. 2, 2006 including prosecution history, including but not limited to Non-Final Rejection dated May 28, 2008 and Final Rejection dated Dec. 22, 2008, Office Action dated Jun. 18, 2009 and Notice of Allowance dated Mar. 6, 2012.
U.S. Appl. No. 11/634,531, filed Dec. 6, 2006, including prosecution history, including but not limited to Office Action dated Feb. 4, 2009; Office Action dated Sep. 4, 2009, Office Action dated Mar. 29, 2010; Final Office Action dated Oct. 5, 2010; Office Action dated Jun. 23, 2011.
U.S. Appl. No. 12/204,129, filed Sep. 4, 2008, including prosecution history, including but not limited to Office Action dated May 31, 2011 and Nov. 17, 2011.
U.S. Appl. No. 12/510,203, filed Jul. 27, 2009, including prosecution history, including but not limited to, Office Action dated Sep. 26, 2011 and Feb. 24, 2012.
U.S. Appl. No. 12/611,830, filed Nov. 3, 2009, including prosecution history, including but not limited to Office Action dated Nov. 4, 2011 and Notice of Allowance dated Feb. 1, 2012 .
U.S. Appl. No. 60/668,022, filed Apr. 4, 2005, including prosecution history.
U.S. Appl. No. 60/708,206, filed Aug. 15, 2005, including prosecution history.
U.S. Appl. No. 60/902,738, filed Feb. 21, 2007, including prosecution history.
U.S. Appl. No. 60/955,854, filed Aug. 14, 2007, including prosecution history.
US Final Office Action re U.S. Appl. No. 10/939,869, filed Sep. 13, 2004, Office Action dated May 17, 2011.
US Office Action (Final) re U.S. Appl. No. 12/140,356, filed Jun. 17, 2008, Office Action dated Mar. 21, 2011.
US Office Action re U.S. Appl. No. 11/584,079, filed Oct. 20, 2006, Office Action dated Apr. 6, 2009.
US Office Action re U.S. Appl. No. 11/634,673, filed Dec. 5, 2006, Office Action dated Nov. 14, 2008.
US Office Action re U.S. Appl. No. 12/417,802, filed Apr. 3, 2009, Office Action dated Jun. 11, 2010.

* cited by examiner

DEVICES FOR THE IDENTIFICATION OF MEDICAL PRODUCTS

CROSS-REFERENCE TO RELATED APPLICATION

This application claims the benefit of U.S. Provisional Patent Application No. 60/796,121, filed on Apr. 27, 2006, the contents of which are incorporated herein by reference in their entirety.

TECHNICAL FIELD

The present invention relates generally to medical products and, more particularly, to devices that facilitate the identification of medical products under low-light or no-light conditions.

BACKGROUND OF THE PRESENT INVENTION

Medical products in kit form are typically carried by military personnel, law enforcement personnel, and rescue personnel or other first responders into emergency situations. The various products chosen for inclusion in the kit are generally those used to at least temporarily address a wound and to stabilize a patient until the patient can be transported to a medical facility. These products generally include bandages, gauze, and compounds such as iodine solutions or other ointments that may be applied to wounds to improve septic conditions. Other products may include smelling salts, salt tablets, and devices for the automatic injection of compounds to treat anaphylactic shock (such as an EPIPEN).

First aid, particularly in military scenarios, must often be administered in less than favorable conditions such as in low light or in the dark. It is often impractical to provide artificial lighting in such scenarios because lighting may be unavailable or may attract hostile attention to both the wounded person and the caregiver. Especially under battle conditions, even the use of pen-type flashlights or similar devices may be susceptible to undesirable detection.

Situations may also occur in which a person's vision is impaired so that he/she may not be able to open the medical kit. A person may also be blinded as a result of foreign objects such as dust, smoke, chemical vapors, blood, or the like in addition to direct injury to the eyes. In these types of situations, no amount of light would enable the blinded person to see sufficiently to self-administer the needed aid. Furthermore, unless a caregiver is adequately equipped with the necessary paraphernalia (respirators or masks) to counter the effects of dust, smoke, chemical vapors, etc., the caregiver is also unlikely to be able to access the medical kit and the contents therein.

There is a current need for an improved manner of identifying emergency medical products under less than adequate lighting conditions or in situations in which vision is impaired.

Based on the foregoing, it is a general object of the present invention to provide devices that facilitate the identification of medical products under low-light or no-light conditions to allow for the application of such products to wounded personnel.

SUMMARY OF THE PRESENT INVENTION

Disclosed herein are devices that facilitate the identification of medical products under low-light or no-light conditions. Such conditions may be encountered in battle situations, in covert operations for purposes relating to reconnaissance or personnel and/or equipment transport, or as a result of climatic or environmental situations. The present invention is not limited in this regard, however, as other uses for the disclosed devices are within the scope of the invention. For example, the devices disclosed herein may also be utilized in conjunction with ammunition holders, communications apparatuses, tools, and the like.

In one aspect, the present invention resides in a pouch in which components of a medical kit are carried, the pouch being identifiable by means other than by the naked eye. The pouch is preferably closable using snaps, hook and loop material, zippers, or the like. The means for identification is attached to or integral with the pouch and may comprise raised and lowered surfaces that can be read by touch; serrations disposed on an edge or surface; a fluorescent coating viewable under infrared or ultraviolet light; or a pattern that is viewable using a thermal imaging device such as night vision goggles.

In another aspect, the present invention resides in a device for the identification of a medical item. The device is attachable to the medical item or to the packaging incorporating the item and includes a substrate and an arrangement of raised and lowered surfaces disposed thereon. The raised and lowered surfaces, which may be ridges, grooves, pimples, dimples, holes, Braille, or combinations thereof, define a pattern that is tactilely recognizable by a user when the user touches the raised and lowered surfaces.

In another aspect, the present invention resides in a device for the selective visual identification of a medical item. The device is attachable to the medical item and includes a substrate and a fluorescent ink disposed thereon. The fluorescent ink is visible under one of infrared light and ultraviolet light and is disposed on the substrate in a recognizable pattern (e.g., a medical cross).

In another aspect, the present invention resides in a device for the identification of a medical item, the device being attachable to the medical item. The device includes a substrate and a coating disposed thereon. The substrate is defined by a material having a first specific heat capacity, and the coating is defined by a material having a second specific heat capacity. The coating is disposed on the substrate in a recognizable pattern. The two specific heat capacities are different, which thereby allows one to be recognized relative to the other when viewed through a thermal imaging apparatus such as night vision goggles.

In another aspect, the present invention resides in a package for retaining a medical item. The package includes an identifying element of a material that is selectively viewable in response to light attributes of the material. The material is arranged to identify the contents of the package via lettering, colorings, graphics, combinations of the foregoing, and the like.

In another aspect, the present invention resides in a medical device that includes a hemostatic agent; a package in which the hemostatic agent is retained; and an identifying element on the package. The identifying element includes a material that is visually discernible in reduced light environments.

In another aspect, the present invention resides in a device for the visual identification of a package containing a medical item. Such a device includes an identifying element comprising a material that is visually discernible in reduced-light environments via the use of night vision devices. The identifying element may be formed into an indicia that indicates the contents of the package.

One advantage of the present invention is that a medical device can be utilized under hostile conditions without drawing unwanted attention. More specifically, by relying on tactile senses or the use of optical devices (such as those emitting infrared or ultraviolet light or those capable of reading thermal infrared radiation), a medical device can be found, opened, and applied as necessary for the treatment of a wound without compromising the position of the user.

Another advantage is that a medical device can be utilized under conditions in which the user is blinded. Rescue personnel, as well as law enforcement and military personnel, can rely on tactile abilities to locate specific items or to distinguish types of items for application in emergency situations such as heavy smoke, dust storms, and the like.

DETAILED DESCRIPTION OF THE PREFERRED EMBODIMENTS

Figure 1:
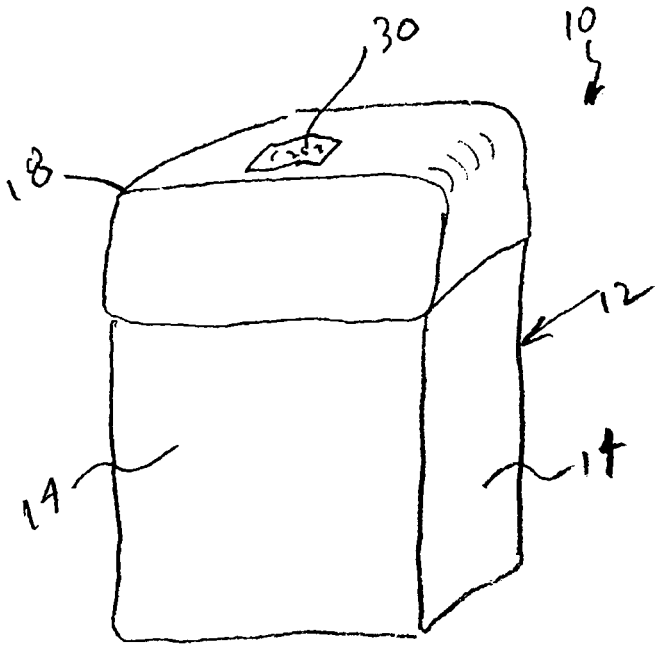
FIG. 1 is a perspective view of the front of a medical kit having an identification device of the present invention.
Figure 2:
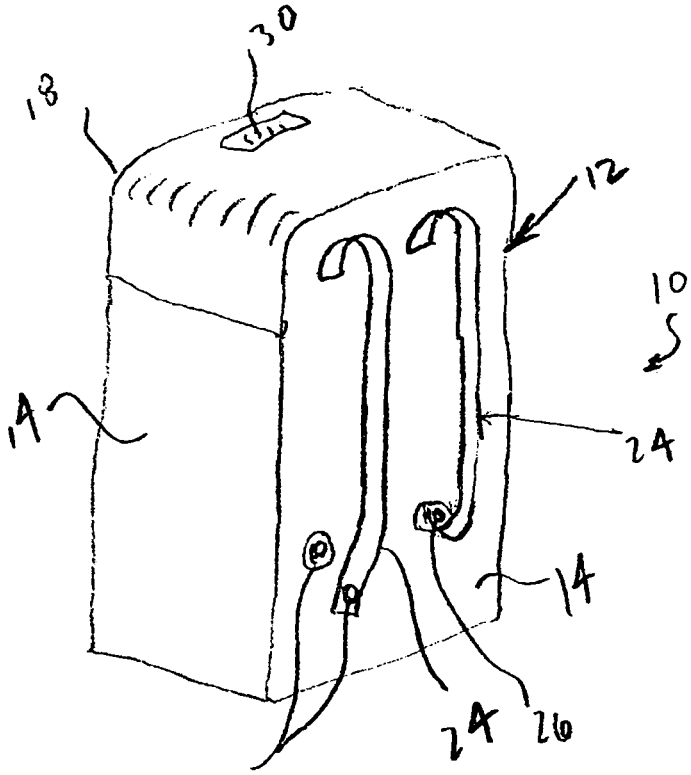
FIG. 2 is a perspective view of the back of the medical kit of FIG. I showing the identification device of the present invention.

As shown in FIGS. 1 and 2, a medical kit generally designated by the number 10 includes a bag or pouch 12 that functions as a receptacle for various components that make up the kit. Components that make up the kit 10 can include, but are not limited to, bandages, antiseptic compounds, tape, and packages or vials of blood clotting agents.

Referring specifically to FIG. 2, an attachment mechanism is also disposed on at least one wall 14 of the pouch 12 to facilitate the attachment of the pouch to a belt, vest, or other garment of the user. The attachment mechanism includes one or more straps 24 that are stitched or otherwise secured to the at least one wall 14 at one end thereof. The straps 24 can be looped around a belt or loops on a garment and attached back to the pouch 12 using snaps 26 (as shown) or any other suitable mechanism (e.g., hook and loop material, quick-release buckles, or the like). The straps 24 may also be utilized in conjunction with a MOLLE connection at the discretion of the user.

Referring to both FIGS. 1 and 2, the pouch 12 includes at least one identifying element 30 having a surface that can be discerned without the naked eye (e.g., by being identified through touch or by being selectively viewable through a device in response to colorings or certain light attributes (phosphorescence or luminescence)). The present invention is not limited in this regard, however, as the pouch 12 may alternatively (or additionally) include at least one identifying element 30 having a surface that can be discerned with the naked eye (e.g., by being identified in response to the certain light attributes (the phosphorescence or luminescence)). The identifying element 30 may form the surface or it may be attached to specific individual components of the kit 10, e.g., the packaging of individual components. Irrespective of where the identifying element 30 is located, the identifying element can be inspected by a user under low-light or no-light conditions to allow the user to determine the type of kit, the contents of the pouch 12, or the particular kit component. In embodiments in which the identifying element 30 is attached to the pouch 12, the identifying element can be located anywhere on the pouch, although the identifying element is preferably located on a top 18 of the pouch to indicate the point at which the pouch can be opened.

Figure 3:
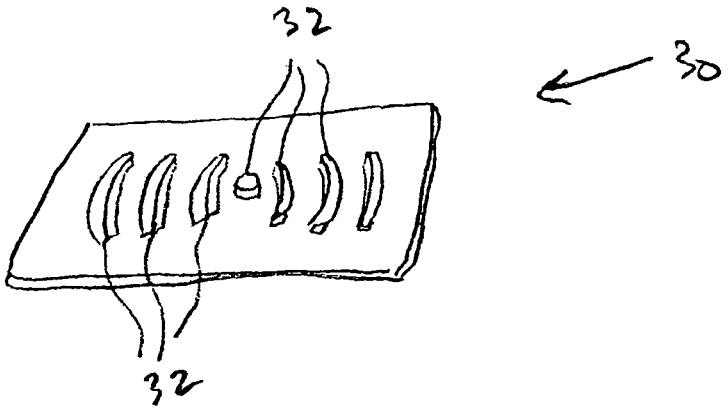
FIG. 3 is a perspective view of the identification device of the present invention in which the device is identifiable by tactile means.

Referring now to FIG. 3, in one exemplary embodiment the identifying element 30 may be a device that provides a tactile sensation. The identifying element 30 may be in the form of a patch, tag, or label or the like embossed or otherwise made to have one or more raised surfaces 32 that, when touched by a user, allow the user to discern a pattern or recognizable indicia. Raised surfaces 32 of the identifying element 30 may be ridges, grooves, buttons, pimples, dimples, holes, conventional Braille nomenclature, combinations of the foregoing, or the like. Material from which the identifying element 30 is manufactured is a material that is not capable of easily being detected using conventional surveillance techniques. The material has a matte (or at least low gloss) finish in order to minimize detection by optical means. Materials include, but are not limited to, nylon, plastic, rubber, cloth, and the like.

Figure 4:
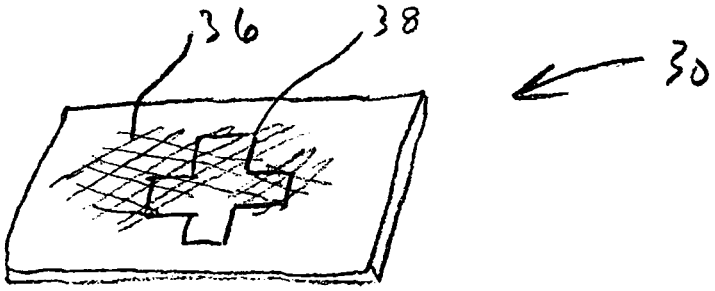
FIG. 4 is a perspective view of the identification device of the present invention in which the device is identifiable by a selectively viewable means.

Referring now to FIG. 4, in another exemplary embodiment the identifying element 30 is a surface that is selectively viewable. The surface may be disposed on a label, tag, patch, or the like for attachment to a bag or pouch. The present invention is not limited in this regard, however, as the surface of the identifying element 30 may be printed, painted, stamped, or inked directly onto a bag or pouch.

In addition to being visible with the naked eye under ambient light conditions, the identifying element 30 includes attributes that allow it to be visually discerned with the naked eye in low-light or no-light environments. Such attributes may be embodied in materials that include, but are not limited to, photoluminescent materials (e.g., an ink 36 or other material). The photoluminescent materials for use with the present invention include, but are not limited to, phosphorescent materials; fluorescent materials; paints, inks, or dyes that emit light when subjected to blacklight; chemical sources such as phenyl oxylate esters; combinations of the foregoing; and the like. Phosphorescent material is particularly useful for devices that are not intended to be used in situations that require stealth (e.g., civilian paramedic and rescue situations).

Also the ink 36 or other material may include a material that is visible under infrared or ultraviolet light or a material that allows the identifying element to be viewed in partial or complete darkness using night observation devices or night vision devices, e.g., night vision goggles and/or night vision monoculars. Passive night vision devices (those which pick up any light in the immediate area and amplify it thereby allowing it to be seen) are preferred over active night vision devices (those which project infrared light and produce an image from the light reflected back). The material may be photoluminescent or it may comprise paints, inks, or dyes of a particular color that facilitates the viewing of the material through night observation devices or night vision devices.

Identifying indicia such as text or other markings may be part of the identifying element 30. For example, a cross 38 or similar recognizable pattern may be superimposed on the ink 36 or material (or the ink or material may be superimposed on the cross) to allow a person to view the identifying element 30 under normal lighting or in low-light or complete darkness.

Figure 5:
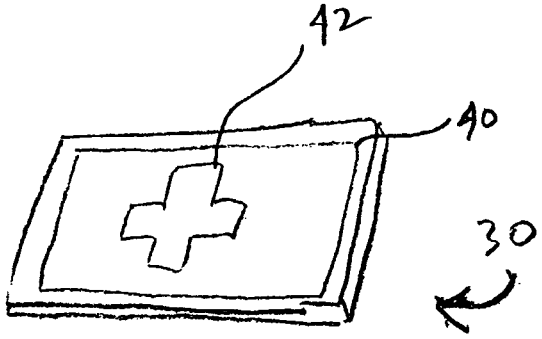
FIG. 5 is a perspective view of the identification device of the present invention in which the device is identifiable by a thermally-imagable means.

Referring to FIG. 5, in any embodiment, a portion of the identifying element 30 may be fabricated from a material having a specific heat capacity, thus allowing it to be imaged thermally. If the identifying element 30 is defined at least in part by a substrate 40 that includes a patterned coating 42 of a disparate material, differences in heat retention properties of the two materials can be simultaneously read and processed to produce an image. For example, if a coating of graphite (specific heat capacity of 0.720 Joules/gram/degree Kelvin) is deposited on brass (specific heat capacity of 0.377 Joules/gram/degree Kelvin), a thermal imaging apparatus can be utilized to view the pattern of the graphite coating (e.g., in the shape of a cross). The thermal imaging apparatus may be one capable of reading thermal infrared radiation, such as a night vision device.

Referring back to FIG. 4, the ink 36 (or other material) may include a material having a first specific heat capacity, and it may be deposited onto a substrate having a second specific heat capacity in such a way so as to define the recognizable pattern. Thus, the identifying element 30 may be read using any one of visible light, infrared or ultraviolet light, or thermal imaging, or it may be viewable as a result of the absorption and re-emission of light.

One of the components that make up the kit 10 may be a blood clotting agent in particle, granule, or powder form for application to a bleeding wound. Such a blood clotting agent is generally zeolite-based, although other types of blood clotting agents are within the scope of the present invention.

Figure 6:
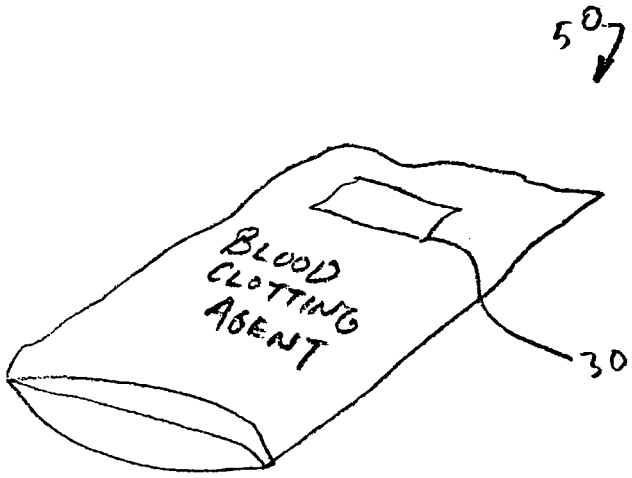
FIG. 6 is a perspective view of a package of blood clotting agent having the identification device of the present invention.

Referring now to FIG. 6, one embodiment of a package in which the blood clotting agent is sealed is shown at 50 and is hereinafter referred to as "package 50." Package 50 includes the identifying element 30 as described above. The identifying element 30 may be a patch or the like configured to impart a tactile sensation, a label having a reflective ink or photoluminescent material as described herein, a marking defined by a reflective ink or photoluminescent material as described herein disposed on a surface of the package, a patterned coating capable of being thermally imaged, or a combination of the foregoing. The identifying element 30 may alternately or additionally be any indicia that is visible under ambient light conditions and visible under low-light or no-light conditions using active or passive night vision goggles or devices. The package 50 is typically a foil that in which the blood clotting agent is vacuum sealed.

Figure 7:
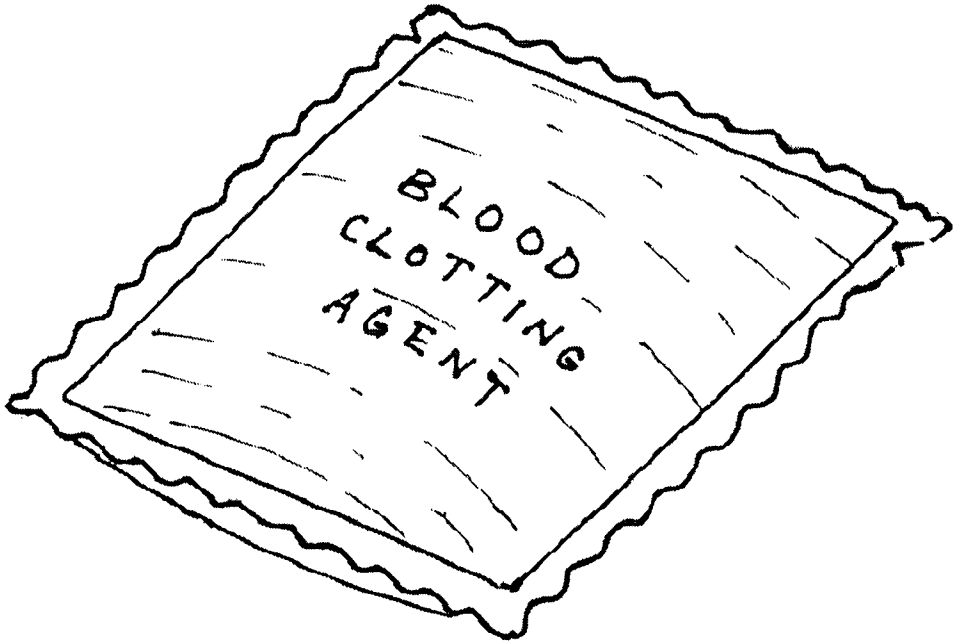
FIG. 7 is a perspective view of a package of blood clotting agent having a serrated edge as the identification device of the present invention.

Referring now to FIG. 7, another embodiment of a package in which the blood clotting agent is sealed is shown at 150 and is hereinafter referred to as "package 150." Package 150 includes a serrated edge 31 as the identifying element. The serrated edge 31 is cut or otherwise formed at the edge of the material forming the package 150. Particularly when the package 150 is fabricated by joining two foil sheets along their respective edges, serrations may be cut into the joined edges. A user may, by touching the serrated edge 31, be able to identify the contents of the package 150. The present invention is not limited in this regard, however, as items other than blood clotting agents may be disposed in the package 150 having the serrated edge 31.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of the appended claims.

What is claimed is:

1. A medical device comprising:

a hemostatic agent;

a package in which said hemostatic agent is retained, the package comprising a matte or low-gloss appearance to the naked eye; and an identifying element on said package, said identifying element comprising a material that provides visual accentuation when viewed through a night vision device in reduced light environments, the accentuation generally not visible to the naked eye both in normal light and in reduced light environments;

wherein the identifying element is positioned on a location of the package where the package is to be opened.

2. The medical device of claim 1, wherein said identifying element comprises a phosphorescent material.

3. The medical device of claim 1, wherein said identifying element includes a material selected from the group consisting of fluorescent materials; paints, inks, and dyes that emit light when subjected to blacklight; phenyl oxylate esters; and combinations of the foregoing.

4. The medical device of claim 1, wherein the medical device is retained in a pouch configured to retain medical products, wherein the pouch further comprises a second identifying element independently coupled to the pouch with respect to the package, wherein the second identifying element comprises a second material that provides visual accentuation when viewed through a night vision device in reduced light environments, the visual accentuation generally not visible to the naked eye in normal light environments and in reduced light environments.

5. The medical device of claim 1, wherein the material comprises a luminescent material.

6. The medical device of claim 1, wherein the material comprises a chemiluminescent material.

7. The medical device of claim 6, wherein the chemiluminescent material comprises a phenyl oxylate ester.

8. The medical device of claim 1, wherein the material comprises a fluorescent material.

9. The medical device of claim 1, wherein the identifying element comprises a material that is visible under infrared light.

10. The medical device of claim 1, wherein the identifying element comprises a material that is visible under ultraviolet light.

11. The medical device of claim 1, wherein the identifying element comprises a material that emits infrared light.

12. The medical device of claim 1, wherein the identifying element comprises a material that absorbs infrared light.

13. The medical device of claim 1, wherein the identifying element comprises a material that emits ultraviolet light.

14. The medical device of claim 1, wherein the identifying element comprises a material that absorbs ultraviolet light.

15. The medical device of claim 1, wherein the identifying element comprises a material that has a different heat capacity than a heat capacity of a second feature of the identifying element.

16. The medical device of claim 1, wherein said package further comprises an edge being defined by a plurality of surfaces, said surfaces defining a pattern that is recognizable by touching said surfaces.

17. The medical device of claim 16, wherein said pattern is a plurality of serrations.

18. The medical device of claim 1, wherein said identifying element is formed into an indicia that indicates the contents of the package.

19. The medical device of claim 1, wherein said package protects said hemostatic agent from liquid and gaseous contamination.

20. The medical device of claim 1, wherein said identifying element further comprises a pattern of raised and lowered surfaces.

21. The medical device of claim 20, wherein said pattern of raised and lowered surfaces consists of ridges, grooves, buttons, dimples, pimples, holes, Braille nomenclature, or combinations of the foregoing.

* * * * *